US008703666B2

(12) United States Patent
Tsou et al.

(10) Patent No.: US 8,703,666 B2
(45) Date of Patent: Apr. 22, 2014

(54) LUBRICANT COMPOSITIONS AND PROCESSES FOR PREPARING SAME

(75) Inventors: Andy Haishung Tsou, Allentown, PA (US); Vera Minak-Bernero, Bridgewater, NJ (US); Martin N. Webster, Pennington, NJ (US); Nikos Hadjichristidis, Athens (GR)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 13/486,345

(22) Filed: Jun. 1, 2012

(65) Prior Publication Data

US 2013/0324447 A1 Dec. 5, 2013

(51) Int. Cl.

| | |
|---|---|
| ***C10M 111/04*** | (2006.01) |
| ***C10M 169/04*** | (2006.01) |
| ***B82B 1/00*** | (2006.01) |

(52) U.S. Cl.

USPC ..... 508/131; 508/113; 977/742

(58) Field of Classification Search

USPC ..... 508/113, 131; 977/742

See application file for complete search history.

(56) References Cited

U.S. PATENT DOCUMENTS

| | | | |
|---|---|---|---|
| 1,185,022 | A | 5/1916 | Swank |
| 2,015,748 | A | 10/1935 | Frolich |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 3,036,003 | A | 5/1962 | Verdol |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,242,075 | A | 3/1966 | Hunter |
| 3,250,715 | A | 5/1966 | Wyman |

(Continued)

FOREIGN PATENT DOCUMENTS

| | | |
|---|---|---|
| CA | 1094044 | 1/1981 |
| EP | 0471071 | 8/1995 |

(Continued)

OTHER PUBLICATIONS

Kraton Polymers—for Modification of Thermoplastics, Nov. 2007, pp. 1-20.*

*Primary Examiner* — Prem Singh
*Assistant Examiner* — Vishal Vasisth
(74) *Attorney, Agent, or Firm* — Robert A. Migliorini

(57) ABSTRACT

Provided is a method for stabilizing a dispersion of a carbon nanomaterial in a lubricating oil basestock. The method includes providing a lubricating oil basestock; dispersing a carbon nanomaterial in the lubricating oil basestock; and adding at least one block copolymer thereto. The at least one block copolymer has two or more blocks includes at least one alkenylbenzene block and at least one linear alpha olefin block. The at least one block copolymer is present in an amount sufficient to stabilize the dispersion of the carbon nanomaterial in the lubricating oil basestock. Also provided is a lubricating engine oil having a composition including: a lubricating oil base stock; a carbon nanomaterial dispersed in the lubricating oil basestock; and at least one block copolymer.

10 Claims, 3 Drawing Sheets

(56) References Cited

U.S. PATENT DOCUMENTS

| | | | | |
|---|---|---|---|---|
| 3,254,025 | A | 5/1966 | LeSuer | |
| 3,272,746 | A | 9/1966 | LeSuer et al. | |
| 3,275,554 | A | 9/1966 | Wagenaar | |
| 3,316,177 | A | 4/1967 | Dorer, Jr. | |
| 3,329,658 | A | 4/1967 | Fields | |
| 3,322,670 | A | 5/1967 | Burt et al. | |
| 3,341,542 | A | 9/1967 | LeSuer et al. | |
| 3,413,347 | A | 11/1968 | Worrel | |
| 3,438,757 | A | 4/1969 | Honnen et al. | |
| 3,444,170 | A | 5/1969 | Norman et al. | |
| 3,449,250 | A | 6/1969 | Fields | |
| 3,454,555 | A | 7/1969 | van der Voort et al. | |
| 3,454,607 | A | 7/1969 | LeSuer et al. | |
| 3,519,565 | A | 7/1970 | Coleman | |
| 3,541,012 | A | 11/1970 | Stuebe | |
| 3,565,804 | A | 2/1971 | Honnen et al. | |
| 3,595,791 | A | 7/1971 | Cohen | |
| 3,630,904 | A | 12/1971 | Musser et al. | |
| 3,632,511 | A | 1/1972 | Liao | |
| 3,652,616 | A | 3/1972 | Watson et al. | |
| 3,666,730 | A | 5/1972 | Coleman | |
| 3,668,125 | A * | 6/1972 | Anderson | 508/591 |
| 3,687,849 | A | 8/1972 | Abbott | |
| 3,697,574 | A | 10/1972 | Piasek et al. | |
| 3,702,300 | A | 11/1972 | Coleman | |
| 3,703,536 | A | 11/1972 | Piasek et al. | |
| 3,704,308 | A | 11/1972 | Piasek et al. | |
| 3,725,277 | A | 4/1973 | Worrel | |
| 3,725,480 | A | 4/1973 | Traise et al. | |
| 3,726,882 | A | 4/1973 | Traise et al. | |
| 3,742,082 | A | 6/1973 | Brennan | |
| 3,751,365 | A | 8/1973 | Piasek et al. | |
| 3,755,433 | A | 8/1973 | Miller et al. | |
| 3,756,953 | A | 9/1973 | Piasek et al. | |
| 3,769,363 | A | 10/1973 | Brennan | |
| 3,787,374 | A | 1/1974 | Adams | |
| 3,798,165 | A | 3/1974 | Piasek et al. | |
| 3,803,039 | A | 4/1974 | Piasek et al. | |
| 3,822,209 | A | 7/1974 | Knapp et al. | |
| 3,876,720 | A | 4/1975 | Heilman et al. | |
| 3,948,800 | A | 4/1976 | Meinhardt | |
| 4,100,082 | A | 7/1978 | Clason et al. | |
| 4,218,330 | A | 8/1980 | Shubkin | |
| 4,234,435 | A | 11/1980 | Meinhardt et al. | |
| 4,239,930 | A | 12/1980 | Allphin et al. | |
| 4,367,352 | A | 1/1983 | Watts, Jr. et al. | |
| 4,413,156 | A | 11/1983 | Watts, Jr. et al. | |
| 4,426,305 | A | 1/1984 | Malec | |
| 4,434,408 | A | 2/1984 | Baba et al. | |
| 4,454,059 | A | 6/1984 | Pindar et al. | |
| 4,767,551 | A | 8/1988 | Hunt et al. | |
| 4,798,684 | A | 1/1989 | Salomon | |
| 4,827,064 | A | 5/1989 | Wu | |
| 4,827,073 | A | 5/1989 | Wu | |
| 4,910,355 | A | 3/1990 | Shubkin et al. | |
| 4,956,122 | A | 9/1990 | Watts et al. | |
| 5,068,487 | A | 11/1991 | Theriot | |
| 5,084,197 | A | 1/1992 | Galic et al. | |
| 5,705,458 | A | 1/1998 | Roby et al. | |
| 5,824,627 | A | 10/1998 | McConnachie et al. | |
| 5,837,657 | A | 11/1998 | Fang et al. | |
| 5,906,968 | A | 5/1999 | McConnachie et al. | |
| 6,010,987 | A | 1/2000 | Stiefel et al. | |
| 6,034,039 | A | 3/2000 | Gomes et al. | |
| 6,110,878 | A | 8/2000 | McConnachie et al. | |
| 6,130,291 | A | 10/2000 | Kennedy et al. | |
| 6,143,701 | A | 11/2000 | Boffa | |
| 6,153,564 | A | 11/2000 | Arunasalam et al. | |
| 6,232,276 | B1 | 5/2001 | Stiefel et al. | |
| 6,569,820 | B2 | 5/2003 | McConnachie et al. | |
| 6,689,725 | B1 | 2/2004 | Gao | |
| 6,730,638 | B2 | 5/2004 | Farng et al. | |
| 6,734,150 | B2 | 5/2004 | Gao et al. | |
| 7,348,298 | B2 | 3/2008 | Zhang et al. | |
| 7,727,414 | B2 | 6/2010 | Hwang | |
| 2004/0209782 | A1 | 10/2004 | Zhang et al. | |
| 2005/0124504 | A1 | 6/2005 | Zhang et al. | |
| 2006/0100110 | A1 * | 5/2006 | Trouve | 508/116 |
| 2007/0293405 | A1 * | 12/2007 | Zhang et al. | 508/113 |
| 2009/0004375 | A1 * | 1/2009 | Kim et al. | 427/163.1 |
| 2009/0306276 | A1 | 12/2009 | Magnet et al. | |
| 2010/0059720 | A1 | 3/2010 | Berkei et al. | |
| 2011/0046027 | A1 | 2/2011 | Zhamu et al. | |

FOREIGN PATENT DOCUMENTS

| | | |
|---|---|---|
| FR | 2893949 | 6/2007 |
| JP | 2005320220 | 11/2005 |
| KR | 804072 | 2/2008 |
| WO | 98/26030 | 6/1998 |
| WO | 99/47629 | 9/1999 |
| WO | 99/66013 | 12/1999 |
| WO | 03/106660 A1 | 12/2003 |
| WO | 2007/135323 | 11/2007 |
| WO | 2010/102759 | 9/2010 |

* cited by examiner

LUBRICANT COMPOSITIONS AND PROCESSES FOR PREPARING SAME

BACKGROUND

This disclosure relates to lubricating engines using formulated lubricating oils to reduce wear and improve engine fuel efficiency. The formulated lubricating oils contain a lubricating oil base stock, at least one carbon nanomaterial dispersed therein, and at least one block copolymer present in an amount sufficient to stabilize the dispersion of carbon nanomaterial in the lubricating oil basestock. The dispersion of in carbon nanomaterials in the lubricating oil is stabilized by the block copolymer such that the lubricating oil exhibits desired antiwear performance and engine fuel efficiency.

FIELD

Lubrication involves the process of friction reduction, accomplished by maintaining a film of a lubricant between surfaces which are moving with respect to each other. The lubricant prevents contact of the moving surfaces, thus greatly lowering the coefficient of friction, in addition to this function, the lubricant also can be called upon to perform heat removal, containment of contaminants, and other important functions. Additives have been developed to establish or enhance various properties of lubricants. Various additives which are used include dispersants, viscosity improvers, detergents, antioxidants, extreme pressure additives, and corrosion inhibitors.

Anti-wear agents, many of which function by a process of interactions with the surfaces, provide a chemical film which prevents metal-to-metal contact under high load conditions. Wear inhibitors which are useful under extremely high load conditions are frequently called "extreme pressure agents". Certain of these materials, however, must be used judiciously in certain applications due to their property of accelerating corrosion of metal parts, such as bearings.

The use of graphite in fluids such as lubricants is well known. The graphite is added as a friction reducing agent, which also carries some of the load imposed on the working fluid, and therefore helps to reduce surface damage to working parts. In order to be low friction, it is well known that the graphite layered structure must contain some water or other material to create the interlayer spacing and thereby lamellar structure. There are various commercially available graphite suspensions which are specifically intended for use in lubricants. The size of the particles is varied for different dispersions, but the minimum average size for commercially available products is in the submicron range, typically mean as 500-800 nm (nanometers).

However, carbon nanomaterials such as graphite have a tendency to fall out from the lubricant solution with prolonged storage, and the performance of carbon nanomaterial-containing lubricants deteriorate with aging.

Fuel economy improvement strongly depends on the reduction of lubricant viscosity. This leads to the more severe contact conditions resulting in more engine wear. There is a need to develop effective antiwear technologies for the low viscosity lubricants that are compliant with environmental regulations.

Despite the advances in lubricant oil formulation technology, there exists a need for an engine oil lubricant that provides superior antiwear performance and effectively improves fuel economy, and has the capability to do so through stabilization of antiwear additives, e.g., carbon nanomaterial-based antiwear additives, dispersed in the lubricant fluid.

SUMMARY

This disclosure relates in part to a method for stabilizing a dispersion of a carbon nanomaterial in a lubricating oil basestock, the method comprising:

providing a lubricating oil basestock;

dispersing a carbon nanomaterial in the lubricating oil basestock; and adding at least one block copolymer thereto, the at least one block copolymer having two or more blocks comprising at least one alkenylbenzene block and at least one linear alpha olefin block;

Wherein the at least one block copolymer is present in an amount sufficient to stabilize the dispersion of said carbon nanomaterial in the lubricating oil basestock.

This disclosure also relates in part to a lubricating engine oil having a composition comprising:

a lubricating oil base stock;

a carbon nanomaterial dispersed in the lubricating oil basestock; and at least one block copolymer, the at least one block copolymer having two or more blocks comprising at least one alkenylbenzene block and at least one linear alpha olefin block;

wherein the at least one block copolymer is present in an amount sufficient to stabilize the dispersion of said carbon nanomaterial in the lubricating oil basestock.

In accordance with this disclosure, an engine oil lubricant provides superior antiwear performance and effectively improves fuel economy, and has the capability to do so through stabilization of antiwear additives, e.g., carbon nanomaterials, dispersed in the lubricant oil.

Other objects and advantages of the present disclosure will become apparent from the detailed description that follows.

DETAILED DESCRIPTION

Figure 1:
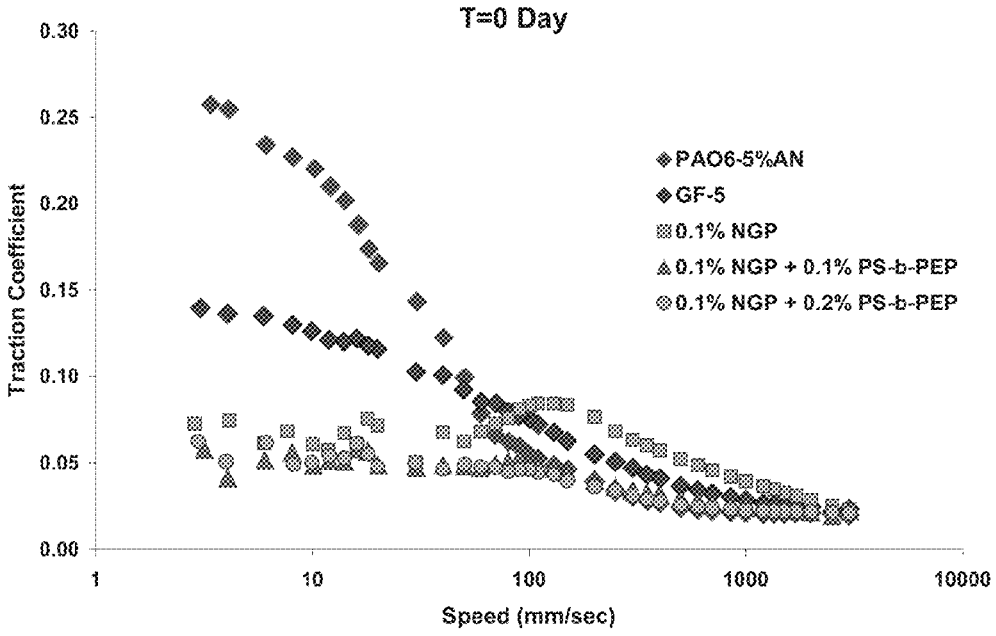
FIG. 1 graphically depicts MTM friction results from measured Stribeck curves for the lubricant blends and oil identified therein at T=0 days storage.

All numerical values within the detailed description and the claims herein are modified by "about" or "approximately" the indicated value, and take into account experimental error and variations that would be expected by a person having ordinary skill in the art.

It has now been found that improved wear protection and fuel efficiency can be attained in an engine lubricated with a lubricating oil comprising a lubricating oil base stock, at least one carbon nanomaterial dispersed therein, and at least one block copolymer present in an amount sufficient to stabilize the dispersion of carbon nanomaterial in the lubricating oil basestock. The lubricating oils of this disclosure are particularly advantageous as passenger vehicle engine oil (PVEO) products.

The lubricating oils of this disclosure provide excellent engine protection including anti-wear performance. The lubricating oils of this disclosure provide improved fuel efficiency.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group TV includes polyalphaolefins (PAO). Group V base stock includes base stocks not included in Groups I-IV. The table below summarizes properties of each of these live groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example. PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarase, dioctyl sebacate, in diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds; hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce tube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluents/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from 50 to 99 weight percent, preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or $mm^2/s$) at 100° C. Mixtures of synthetic and natural base oils may be used if desired.

Carbon Nanomaterials

The formulated lubricating oils useful in the present disclosure contain one or more carbon nanomaterials. Illustrative carbon based nanoparticles include, for example, carbon nanotubes of single, double, or multi-walls, or carbon nanofibers, or graphenes, or graphene oxide, or nano graphene platelets. The carbon nanoparticles are conventional materials known in the art.

The diameters of these carbon nanotubes and nanofibers can vary over a wide size range. Preferably, the diameters are less than 250 nm, more preferably less than 200 nm, most preferably less than 150 nm, while having lengths that are preferably greater than 1 micron, more preferably greater than 5 microns, and most preferably greater than 10 microns. The widths of graphenes, graphene oxides, or nano graphene platelets are preferably less than 100 microns, more preferably less than 75 microns, and most preferably less than 50 microns, while their thickness values are preferably less than 100 nm, more preferably less than 50 nm, and most preferably less than 20 nm.

It is important that the carbon nanoparticles are dispersed in the lubricating oil sufficient for the lubricating oil to exhibit improved antiwear performance.

The carbon nanomaterials are typically used in amounts of from 0.005 weight percent to 10 weight percent, preferably from 0.01 weight percent to 5 weight percent, and more preferably from 0.05 weight percent to 2.0 or 2.5 weight percent, based on the total weight of the lubricating oil, although more or less can often be used advantageously. The amount used should be sufficient to impart wear resistance in the lubricating oil.

Block Copolymers

The formulated lubricating oils useful in the present disclosure contain one or more block copolymers. The block copolymers include two or more blocks with at least one alkenylbenzene block and one linear alpha olefin block. The block copolymers are used for dispersing the carbon based nano-particles having graphitic surfaces in lubricants and lubricant products for friction and wear reduction. The block copolymers can be prepared by conventional processes, in particular, processes described herein.

Most specifically, the alkenylbenzene block has a molecular weight from 500 to 500,000, more preferably from 1,000 to 250,000, and most preferably from 1,500 to 100,000 based on alkenylbenzenes such as styrene, para-methyl styrene, or any benzene ring containing vinyl monomers.

The linear alpha olefin block needs to be amorphous and can be based on homo or copolymerization of linear alpha olefins from ethylene to decene to octadecene having molecular weight from 500 to 500,000, more preferably from 1.000 to 250,000, and most preferably from 1,500 to 100,000.

The alkenylbenzene block is necessary to provide phi to phi interactions with the graphitic surfaces present on carbon-based nano-particles. "Phi" refers to phi bond, which is specifically related to the interactions between aromatic rings, typically called phi and phi (star) interactions or the interactions between the hybrid orbitals of the aromatic rings. The linear alpha olefin block is needed to compatibilize and solubilize the copolymers in hydrocarbon base stocks, from Groups 1-5, including PAOs (polyalphaolefin). The alkenylbenzene block is sufficient to provide phi to phi interactions with graphitic surfaces present on the carbon nano-material. For the purposes of the instant disclosure, "sufficient to provide phi to phi interactions" means that the alkenylbenzene block have more than 3 monomers (more than 3 phenyl rings since each monomer would contain at least one ring), preferably more than 5 monomers, and even more preferably more than 10 monomers. This would sufficiently provide enough interactions at the surface to pin down the diblocks.

It is important that the block copolymers stabilize the dispersion of carbon nanoparticles in the lubricating oil sufficient for the lubricating oil to exhibit improved antiwear performance.

The block copolymers are typically used in amounts of from 0.005 weight percent to 10 weight percent, preferably from 0.01 weight percent to 5 weight percent, and more preferably from 0.05 weight percent to 1.0 or 2.0 weight percent, based on the total weight of the lubricating oil, although more or less can often be used advantageously.

Other Additives

The formulated lubricating oil useful in the present disclosure may additionally contain one or more of the other commonly used lubricating oil performance additives including but not limited to dispersants, detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants in are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329.658; 3,449.250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HN®_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 weight percent, preferably 0.5 to 8 weight percent.

Detergents

A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of 1.05:1 to 50:1 on an equivalent basis. More preferably, the ratio is from 4:1 to 25:1. The resulting detergent is an overbased detergent that will typically have a TBN of 150 or higher, often 250 to 450 or more. Preferably, the overbasing cation is sodium, calcium, or magnesium. A mixture of detergents of differing TBN can be used in the present disclosure.

Preferred detergents include the alkali or alkaline earth metal salts of sulfonates, phenates, carboxylates, phosphates, and salicylates, e.g., a mixture of magnesium sulfonate and calcium salicylate.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have 3 to 70 carbon atoms. The alkaryl sulfonates typically contain 9 to 80 carbon or more carbon atoms, more typically from 16 to 60 carbon atoms.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

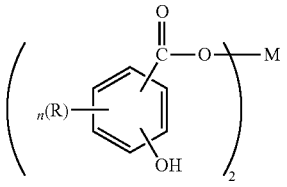

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a to polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents) in any combination. A preferred detergent includes magnesium sulfonate and calcium salicylate.

The detergent concentration in the lubricating oils of this disclosure can range from 1.0 to 6.0 weight percent, preferably 2.0 to 5.0 weight percent, and more preferably from 2.0 weight percent to 4.0 weight percent, based on the total weight of the lubricating oil.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8$-$R^9$-$R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alpha-naphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, most preferably zero.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2.655, 479; 2,666,746; 2,721,877; 2,721,878; and 3,250,715 describe useful pour point depressants and/or the preparation thereof. Such additives may be used in an amount of 0.01 to 5 weight percent, preferably 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of 0.01 to 3 weight percent, preferably 0.01 to 2 weight percent.

Antifoam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 weight percent and often less than 0.1 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metalligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols; thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc, See U.S. Pat. Nos. 5,824,627, 6,232,276, 6,153,564, 6,143,701, 6,110,878, 5,837,657, 6,010,987, 5,906,968, 6,734,150, 6,730,638, 6,689,725, 6,569,820; WO 99/66013; WO 99/47629; and WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 weight percent to 10-15 weight percent or more, often with a preferred range of 0.1 weight percent to 5 weight percent. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

Viscosity Index Improvers

Viscosity index improvers (also known as VI improvers, viscosity modifiers, and viscosity improvers) can be included in the lubricant compositions of this disclosure. Preferably, the method of this disclosure obtains improvements in fuel economy without sacrificing durability by a reduction of high-temperature high-shear (HTHS) viscosity to a level lower than 2.6 cP through reduction or removal of viscosity index improvers or modifiers.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC™ 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than 2.0 weight percent, preferably less than 1.0 weight percent, and more preferably less than 0.5 weight percent, based on the total weight of the formulated oil or lubricating engine oil.

In another embodiment of this disclosure, the viscosity index improvers may be used in an amount of from 0.0 to 2.0 weight percent, preferably 0.0 to 1.0 weight percent, and more preferably 0.0 to 0.5 weight percent, based on the total weight of the formulated oil or lubricating engine oil.

When lubricating oil compositions contain one or more of the additives discussed above, the additive(s) are blended into the composition in an amount sufficient for it to perform its intended function. Typical amounts of such additives useful in the present disclosure are shown in Table A below.

It is noted that many of the additives are shipped from the additive manufacturer as a concentrate, containing one or more additives together, with a certain amount of base oil diluents. Accordingly, the weight amounts in the table below, as well as other amounts mentioned in this specification, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 1.0-6.0 | 2.0-4.0 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-Foam Agent | 0.001-3 | 0.001-0.15 |
| Viscosity Index Improver (solid polymer basis) | 0.0-2 | 0.0-1 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Synthesis of PS-b-PEP Diblock Dispersant

The poly(styrene-b-1,4-isoprene) diblock copolymers (PS-b-PI) were synthesized by sequential anionic polymerization high vacuum techniques, in benzene at room temperature, with sec-BuLi as initiator. After completion of the sequential living polymerization, the living ends were neutralized degassed methanol. The general reactions of the synthesis are given below:

styrene+sec-BuLi - - - benzene, RT - - - >$PS^-Li^+$ $PS^-Li^+$+isoprene - - - benzene, RT - - - >PS-b-$PI^-Li^+$ PS-b-$PI^-Li^+$+MeOH - - - >PS-b-PI+MeOLi The number-average molecular weights of the polystyrene (PS) blocks and the final diblock copolymers (PS-b-PI) were determined by membrane osmometry. The values of the polydispersity index (PDI) of the PS blocks and final copolymers, as determined by gel permeation chromatography, were all below 1.1 (PDI<1.1). The microstructure of the polyisoprene (PI) blocks determined by NMR ($^1H$ and $^{13}C$) was found to be cis:trans:vinyl=72:20:8. One PS-b-PI copolymer was selected for dispersion evaluations and it had PS molecular weight (Mw) of 22,000 and PI Mw of 35,000.

The 22K-35K Mw PS-b-PI was dissolved in p-xylene (0.3 to 0.4 M repeat unit concentration) in a dry, glass reaction vessel purged with inert gas and fitted with a condenser and stir bar. A small amount of BHT (0.1-0.2% by weight polymer) was added. The solution was sparged with inert gas for at least one hour before 6 molar equivalents (relative to the polymer repeat unit) of tosylhydrazide was added to the flask. The reaction was heated to 125-130° C. for 6 hours under a blanket of inert gas. The flask was cooled, the contents were filtered to remove any solid by-product and the polymer solution was concentrated on a rotary evaporator. The polymer was then precipitated by pouring the concentrated solution into a large excess of stirring methanol. The polymer was further purified by reprecipitation in methanol. The material was dried under vacuum and weighed for yield. It has less than 0.5% residual double bonds after hydrogenation as measured by solution NMR. The isoprene unit became alternated ethylene-propylene unit after hydrogenation and PS-b-PI became PS-b-PEP.

Preparation of Lubricant Solutions

Nano graphene platelets, NGPs, supplied by Angstron Materials (Dayton, Ohio), were used as is. They are graphene, not graphene oxide, platelets with an oxygen content of 0.5%. 75% of those NGPs had a thickness value less than 10 nm. Based on a Malvern particle size analyzer, their D10 value was 4 to S microns, D50 was 10 to 14 microns, and D90 was 16 to 26 microns. The lubricant base stock used was a PAO 6 (Polyalphaolefin, 6 centistokes viscosity, ExxonMobil Chemical) blended with 5% AN (alkylated naphthalene, ExxonMobil Chemical).

Three blends were made and they are listed in Table 2. For the blends containing the PS-b-PEP dispersant, the dispersant was first dissolved in PAO at 100° C. with stirring. Afterward, NGPs were added to all blends and the blends were stirred using a Multi-Tube vortexer for 5 minutes at room temperature with a motor speed setting of 7. All blends were then further mixed using a high shear mixer (IKA Ultra-Turrax T25 dispenser equipped with S25N-18G dispensing tool) for 20 minutes at 20,000 rpm. A GE-5 reference 0 W-20 lubricant with the same PAO/AN base stock was used in all subsequent tribology tests. This GE-5 reference oil contains additives representative of those found in gasoline engine oil products.

TABLE 2

Lubricant Blends Evaluated

| Example | Base Stock | NGP (wt %) | PS-b-PEP (wt %) |
|---|---|---|---|
| 1 | PAO4 + AN | 0.1 | 0 |
| 2 | PAO4 + AN | 0.1 | 0.1 |
| 3 | PAO4 + AN | 0.1 | 0.2 |
| GF-5 (Reference) | PAO4 + AN | 0 | 0 |

Tribological Properties

Figure 2:
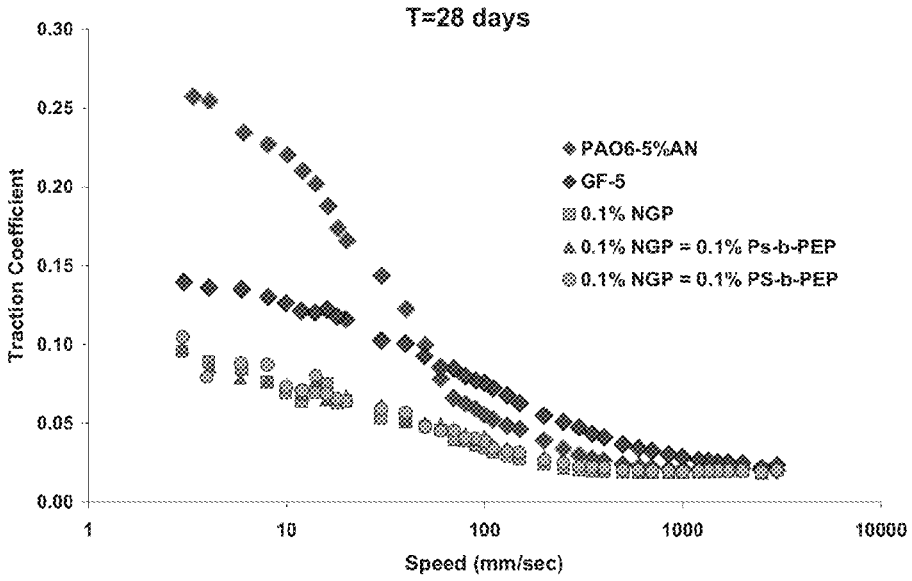
FIG. 2 graphically depicts MTM friction results from measured Stribeck curves for the lubricant blends and oil identified therein at T=28 days storage.

A mini traction machine (MTM) (MTM2, PCS Instruments) was used to measure the Stribeck curves for all three blends and the reference oil listed in Table 1 at 100"C. The pressure of the MTM was set at 1 GPa with a 50% SRR (Slide to Roll Ratio) while running from 0.003 to 3 mm/s sliding speed. Measured Stribeck curves for all lube blends and oil are shown in FIG. 1 and Stribeck curves for those solutions after 28 days of storage are shown in FIG. 2.

By dispersing low friction materials in an engine oil, the friction could be reduced by a factor of 2 or more under boundary lubrication conditions giving friction coefficients in the range of 0.05 or lower. The use of a PS-b-PEP diblock to enhance the dispersion stability of NGPs did not reduce the ability of the resulting blend to reduce friction under boundary lubrication conditions. Furthermore it was noted that a lower friction was obtained in the transition between full film and boundary lubrication conditions when compared with NOPs used without the PS-b-PEP diblock. The use of the diblock dispersant enables the NGP to reduce friction over a broader range of lubrication conditions. Stribeck curves for the NGP containing blend tested after 28 days storage appear to have maintained the ability to reduce friction compared with the original blended not containing NGP.

Dispersion Stability

Figure 3:
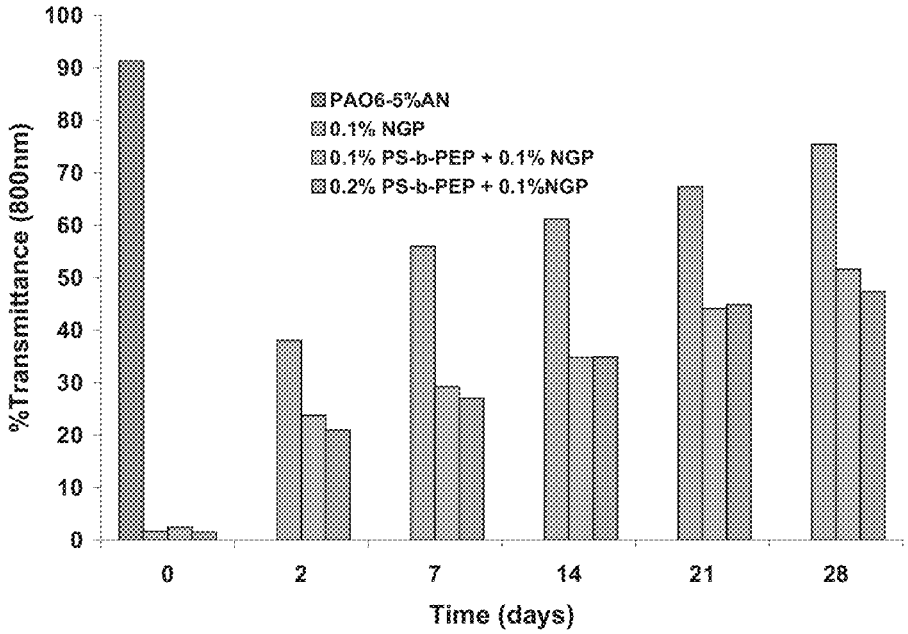
FIG. 3 graphically depicts light transmittance values of lubricant solutions identified therein as a function of storage time.

A UV/VIS microplate spectrophotometer (Molecular Derives Spectra ax Plus-384) was used to measure the solution light transmittance at 800 nm light wavelength. As shown in FIG. 3, the light transmittance of the PAO/AN base stock was 91%. The addition of black NOP platelets led to opaque solutions with transmittance below 3%. If those NGP platelets start to precipitate or to settle out from the solution with time, the solution would become clearer with higher transmittance. As indicated in FIG. 3, without the use of the PS-b-PEP diblock dispersant, the solution has 75% transmittance after 28 days suggesting that more than 80% of the original NGP platelets have settled out from the solution assuming linear dependence of light transmission on NGP concentration. By using 0.2% PS-b-PEP diblock dispersion, the transmittance was measured at 47% suggesting approximately 50% of the NGP platelets are still suspended in the solution. The benefit of using a PS-b-PEP dispersant to stabilize NGP dispersions is clearly demonstrated. A minimal removal of NGP may be necessary to preserve the low traction coefficient obtained from the fresh solution in an aged solution.

PCT and EP Clauses:

1. A method for stabilizing a dispersion of a carbon nanomaterial in a lubricating oil, said method comprising:
   - providing a lubricating oil basestock;
   - dispersing a carbon nanomaterial in said lubricating oil basestock; and
   - adding at least one block copolymer thereto, said at least one block copolymer having two or more blocks comprising at least one alkenylbenzene block and at least one linear alpha olefin block;
   - wherein said at least one block copolymer is present in an amount sufficient to stabilize the dispersion of said carbon nanomaterial in said lubricating oil basestock, 2. The method of clause I wherein the lubricating oil basestock comprises a Group I, Group II, Group III, Group IV or Group V base oil.

3. The method of clauses 1 and 2 wherein the carbon nanomaterial comprises carbon nanotubes of single, double, or multi-walls, carbon nanofibers, graphenes, graphene oxide, or nano graphene platelets.

4. The method of clauses 1-3 wherein the alkenylbenzene block is selected from the group consisting of styrene, para-methyl styrene, and a benzene ring containing vinyl monomers, having a molecular weight from 500 to 500,000.

5. The method of clauses 1-4 wherein the linear alpha olefin block results from homo or copolymerization of linear alpha olefins from ethylene to octadecene, having molecular weight from 500 to 500,000.

6. The method of clauses 1-5 wherein the alkenylbenzene block is sufficient to provide phi to phi interactions with graphitic surfaces present on the carbon nano-material, and the linear alpha olefin block is amorphous and is sufficient to compatibilize and solubilize copolymers in the lubricating oil basestock.

7. The method of clauses 1-6 wherein the lubricating oil basestock is present amount of from 70 weight percent to 95 weight percent, the carbon nanomaterial present in an amount of from 0.005 weight percent to 10 weight percent, and the block copolymer is present in an amount of from 0.005 weight percent to 10 weight percent, based on the total weight of the lubricating oil.

8. A lubricating engine oil lubricating engine oil having a composition comprising:
   - a lubricating oil base stock;
   - a carbon nanomaterial dispersed in said lubricating oil basestock; and
   - at least one block copolymer, said at least one block copolymer having two or more blocks comprising at least one alkenylbenzene block and at least one linear alpha olefin block;
   - wherein said at least one block copolymer is present an amount sufficient to stabilize the dispersion of said carbon nanomaterial in said lubricating oil basestock.

9. The lubricating engine oil of clause 8 wherein the lubricating oil basestock comprises a Group I, Group II, Group III, Group IV or Group V base oil.

10. The lubricating engine oil of clause 8 wherein the carbon nanomaterial comprises carbon nanotubes of single, double, or multi-walls, carbon nanofibers, graphenes, graphene oxide, or nano graphene platelets.

11. The lubricating engine oil of clauses 8-10 wherein the alkenylbenzene block is selected from the group consisting of styrene, para-methyl styrene, and a benzene ring containing vinyl monomers, having a molecular weight from 500 to 500,000.

12. The lubricating engine oil of clauses 8-10 wherein the linear alpha olefin block results from homo or copolymerization of linear alpha olefins from ethylene to octadecene, having molecular weight from 500 to 500,000.

13. The lubricating engine oil of clauses 8-12 wherein the alkenylbenzene block is sufficient to provide phi to phi interactions with graphitic surfaces present on the carbon nanomaterial, and the linear alpha olefin block is amorphous and is sufficient to compatibilize and solubilize copolymers in the lubricating oil basestock.

14. The lubricating engine oil of clauses 8-13 wherein the lubricating oil basestock comprises poly alpha olefin (PAO), the carbon nanomaterial comprises nano graphene platelets, and the block copolymer comprises PS-b-PEP.

15. The lubricating engine oil of clauses 8-14 wherein the lubricating oil basestock is present in an amount of from 70 weight percent to 95 weight percent, the carbon nanomaterial present in an amount of from 0.005 weight percent to 10 weight percent, and the block copolymer is present in an amount of from 0.005 weight percent to 10 weight percent, based on the total weight of the lubricating oil.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for stabilizing a dispersion of a carbon nanomaterial in a lubricating oil, said method comprising:

providing a lubricating oil basestock wherein the lubricating oil basestock comprises a poly alpha olefin (PAO) or gas-to-liquid (GTL) oil base stock;

dispersing a carbon nanomaterial in said lubricating oil basestock; and adding a least one block copolymer thereto, said at least one block copolymer having two or more blocks comprising at least one alkenylbenzene block and at least one linear alpha olefin block;

wherein said at least one block copolymer is present in an amount sufficient to stabilize the dispersion of said carbon nanomaterial in said lubricating oil basestock;

wherein the alkenylbenzene block is selected from the group consisting of styrene, para-methyl styrene, and a benzene ring containing vinyl monomers, having a molecular weight from 500 to 22,000;

wherein the linear alpha olefin block results from homo or copolymerization of linear alpha olefins from ethylene to octadecene having molecular weight from 500 to 35,000, and wherein the lubricating oil basestock is present in an amount of from 70 weight percent to 95 weight percent, the carbon nanomaterial present in an amount of from 0.005 weight percent to 10 weight percent, and the block copolymer is present in an amount of from 0.005 weight percent to 10 weight percent, based on the total weight of the lubricating oil.

2. The method of claim 1 wherein the carbon nanomaterial comprises carbon nanotubes of single, double, or multi-walls, carbon nanofibers, graphenes, graphene oxide, or nano graphene platelets.

3. The method of claim 1 wherein the alkenylbenzene block is sufficient to provide phi to phi interactions with graphitic surfaces present on the carbon nanomaterial.

4. The method of claim 1 wherein the linear alpha olefin block is amorphous and is sufficient to compatibilize and solubilize copolymers in the lubricating oil basestock.

5. The method of claim 1 wherein the lubricating oil basestock comprises poly alpha olefin (PAO), the carbon nanomaterial comprises nano graphene platelets, and the block copolymer comprises PS-b-PEP.

6. A lubricating engine oil having a composition comprising:

a lubricating oil basestock wherein the lubricating oil basestock comprises a poly alpha olefin (PAO) or gas-to-liquid (GTL) oil base stock;

a carbon nanomaterial dispersed in said lubricating oil basestock; and at least one block copolymer, said at least one block copolymer having two or more blocks comprising at least one alkenylbenzene block and at least one linear alpha olefin block;

wherein said at least one block copolymer is present in an amount sufficient to stabilize the dispersion of said carbon nanomaterial in said lubricating oil basestock;

wherein the alkenylbenzene block is selected from the group consisting of styrene, para-methyl styrene, and a benzene ring containing vinyl monomers, having a molecular weight from 500 to 22,000;

wherein the linear alpha olefin block results from homo or copolymerization of linear alpha olefins from ethylene to octadecene having molecular weight from 500 to 35,000, and wherein the lubricating oil basestock is present in an amount of from 70 weight percent to 95 weight percent, the carbon nanomaterial present in an amount of from 0.005 weight percent to 10 weight percent, and the block copolymer is present in an amount of from 0.005 weight percent to 10 weight percent, based on the total weight of the lubricating oil.

7. The lubricating engine oil of claim 6 wherein the carbon nanomaterial comprises carbon nanotubes of single, double, or multi-walls, carbon nanofibers, graphenes, graphene oxide, or nano graphene platelets.

8. The lubricating engine oil of claim 6 wherein the alkenylbenzene block is sufficient to provide phi to phi interactions with graphitic surfaces present on the carbon nanomaterial.

9. The lubricating engine oil of claim 7 wherein the linear alpha olefin block is amorphous and is sufficient to compatibilize and solubilize copolymers in the lubricating oil basestock.

10. The lubricating engine oil of claim 6 wherein the lubricating oil basestock comprises poly alpha olefin (PAO), the carbon nanomaterial comprises nano graphene platelets, and the block copolymer comprises PS-b-PEP.

* * * * *